US007127911B2

(12) United States Patent
Nam et al.

(10) Patent No.: US 7,127,911 B2
(45) Date of Patent: Oct. 31, 2006

(54) KIMCHI REFRIGERATORS

(75) Inventors: Jeong-Man Nam, Kwangju (KR); Yong-Myoung Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 370 days.

(21) Appl. No.: 10/729,991

(22) Filed: Dec. 9, 2003

(65) Prior Publication Data

US 2004/0211211 A1 Oct. 28, 2004

(30) Foreign Application Priority Data

Apr. 26, 2003 (KR) ..... 10-2003-0026577

(51) Int. Cl.

| | |
|---|---|
| ***F25D 11/00*** | (2006.01) |
| ***E05F 1/14*** | (2006.01) |
| ***E05F 1/08*** | (2006.01) |
| ***B65D 43/22*** | (2006.01) |

(52) U.S. Cl. ..... 62/440; 16/284; 16/303; 202/826; 202/830

(58) Field of Classification Search ..... 62/440; 16/284, 303, 335, 336, 342; 220/830, 520, 220/826

See application file for complete search history.

(56) References Cited

U.S. PATENT DOCUMENTS 6,122,801 A * 9/2000 Reichert et al. ..... 16/284

FOREIGN PATENT DOCUMENTS

| | | | |
|---|---|---|---|
| KR | 2002004462 A | * | 1/2002 |
| KR | 2003-9829 | | 2/2003 |

* cited by examiner

*Primary Examiner*—Chen Wen Jiang
(74) *Attorney, Agent, or Firm*—Staas & Halsey LLP

(57) ABSTRACT

A kimchi refrigerator includes a cabinet to define an external appearance of the kimchi refrigerator. The cabinet includes a storage compartment to store food. The storage compartment is opened at a top thereof to form an opening. A lid is hinged to a predetermined portion of the cabinet to close the opening of the cabinet. A hinge unit hinges the lid to the predetermined portion of the cabinet. In this case, first and second cam units are included at both ends of the hinge unit to be mounted to both sides, or corners, of the lid to open or close the lid.

9 Claims, 2 Drawing Sheets

KIMCHI REFRIGERATORS

CROSS-REFERENCE TO RELATED APPLICATION

This application claims the benefit of Korean Application No. 2003-26577, filed Apr. 26, 2003 in the Korean Intellectual Property Office, the disclosure of which is incorporated herein by reference.

BACKGROUND OF THE INVENTION

1. Field of the Invention

The present invention relates, in general, to kimchi refrigerators and, more particularly, to a kimchi refrigerator having a hinge unit to make a lid be rotatably hinged to a cabinet.

2. Description of the Related Art

Generally, a kimchi refrigerator is designed to supply cool air, which is generated from an evaporator according to a refrigeration cycle, to a storage compartment, thus maintaining the freshness of food stored in the storage compartment for lengthy periods. A conventional kimchi refrigerator includes a cabinet that defines an external appearance of the kimchi refrigerator. A storage compartment is defined in the cabinet. A lid is rotatably hinged to a predetermined portion of the cabinet to open or close the storage compartment. Several electric devices which execute the refrigeration cycle are installed in the cabinet to supply cool air to the storage compartment.

Hinge units are mounted to a predetermined position of the cabinet to connect the lid rotatably to the cabinet. According to the conventional kimchi refrigerator, two hinge units are mounted along a side of the cabinet to allow the lid to be stably opened and closed.

However, the manufacture of the conventional kimchi refrigerator is problematic in that two hinge units are mounted to the cabinet, making it complicated and labor intensive to assemble the hinge units to the cabinet.

SUMMARY OF THE INVENTION

Accordingly, it is an aspect of the present invention to provide a kimchi refrigerator having a hinge unit, which is easily assembled with a cabinet.

Additional aspects and/or advantages of the invention will be set forth in part in the description which follows and, in part, will be obvious from the description, or may be learned by practice of the invention.

The above and/or other aspects are achieved by providing a kimchi refrigerator, including a cabinet which defines an external appearance of the kimchi refrigerator, and forms a storage compartment which is opened at the top to form an opening that stores food. A lid hinged to a predetermined portion of the cabinet is used to close the opening of the cabinet, and a hinge unit is used to hinge the lid to the predetermined portion of the cabinet, with first and second cam units included at both ends of the hinge unit to be connected to the lid to open or close the lid.

The hinge unit includes a hinge casing having a longitudinal open hinge channel at each of both ends to mount the first and second cam units to both ends of the hinge casing, and a hinge cap to cover the open hinge channel, thus preventing each of the first and second cam units from being removed from the hinge channel.

Each of the first and second cam units includes a stationary cam, a movable cam, and an elastic member. The stationary cam has a hinge projection at a first end, and has a cam part at a second end, the hinge projection passes through the hinge cap to be mounted to the lid and the cam part having an irregular form. The movable cam has a plurality of cam projections at a first end thereof to correspond to the irregular form of the cam part. The elastic member functions to elastically bias a second end of the movable cam, thus allowing the movable cam to be retractably set in the hinge channel.

Further, seating recesses are formed at both edges of a rear end side of the lid to correspond to the shape of the hinge projections, thus allowing the hinge projections to be seated in the seating recesses. A cover member is mounted to the lid to cover each of the seating recesses, thus allowing each of the hinge projections to be installed between the lid and the cover member.

BRIEF DESCRIPTION OF THE DRAWINGS

These and other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
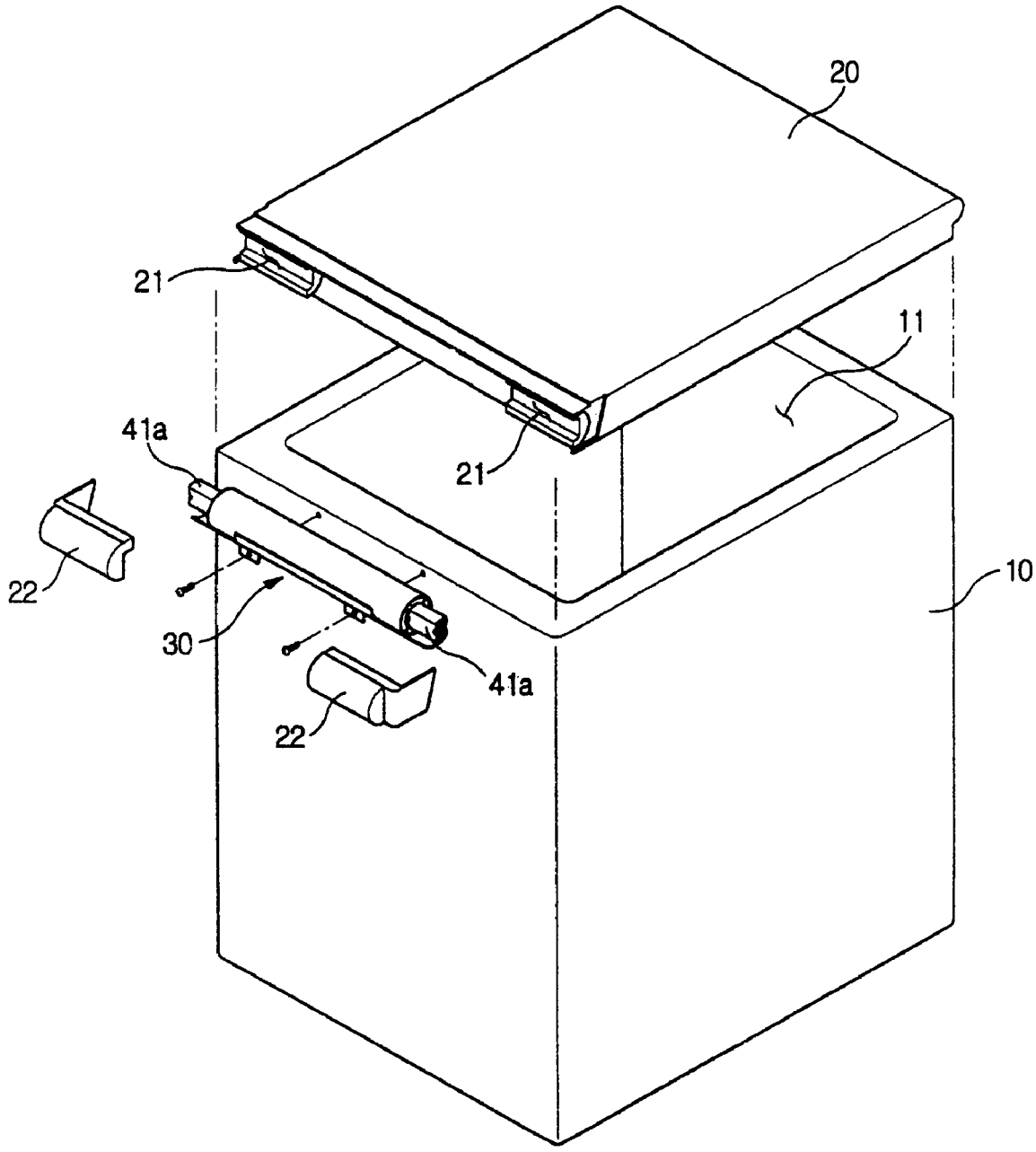
FIG. 1 is an exploded perspective view of a kimchi refrigerator, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As illustrated in FIG. 1, a kimchi refrigerator according to an embodiment of the present invention includes a cabinet 10 to define an external appearance of a kimchi refrigerator. A storage compartment 11 is defined in the cabinet 10, and is opened at a top thereof, thus allowing a user to put kimchi into the storage compartment 11. A lid 20 is rotatably mounted to a predetermined portion of the cabinet 10 to open or close the storage compartment 11. Although not shown in the drawings, a compressor, an evaporator, and a condenser and other items that are necessary to execute a refrigeration cycle, are installed in the cabinet 10 to generate cool air which cools food stored in the storage compartment 11, thus storing the food for lengthy periods.

Further, the kimchi refrigerator according to an embodiment of the present invention includes a hinge unit 30. The hinge unit 30 is mounted to an upper portion of a rear side portion of the cabinet 10. The lid 20 is rotatably hinged to the cabinet 10 by the hinge unit 30 to open or close the storage compartment 11.

Figure 2:
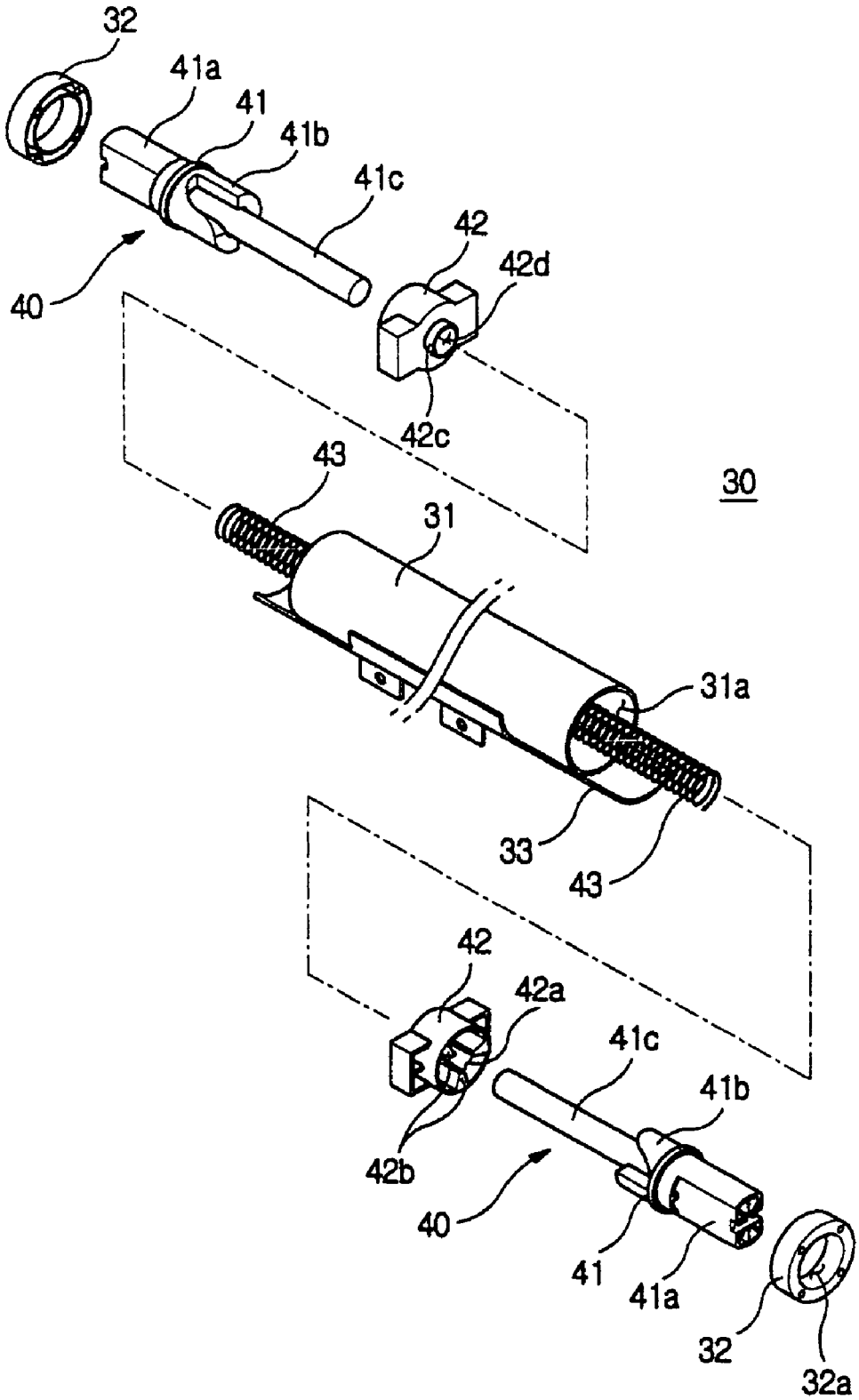
FIG. 2 is an exploded perspective view of a hinge unit included in the kimchi refrigerator, according to an embodiment of the present invention.

As illustrated in FIG. 2, the hinge unit 30 includes a cylindrical hinge casing 31, and first and second cam units 40. The first and second cam units 40 are mounted to opposite ends of the hinge casing 31, respectively, to generate a rotating force according to an angle between the cabinet 10 and the lid 20, so as to rotate the lid 20 to an open or closed position. An open hinge channel 31*a* is formed at each end of the hinge casing 31 to mount the first and second cam units 40 to both ends of the hinge casing 31. A hinge cap 32 covers the open hinge channel 31*a*, thus preventing each of the first and second cam units 40 from being removed from the hinge channel 31*a*. Further, a hinge bracket 33 is formed at a lower portion of the hinge casing 31, thus mounting the hinge unit 30 to the upper portion of the rear side portion of the cabinet 10 using a fastener, such as screws, rivets or bolts.

Each of the first and second cam units 40 includes a stationary cam 41, and a movable cam 42. The stationary cam 41 is mounted, at a first end, to the lid 20 and is rotated along with the lid 20. The movable cam 42 is elastically biased by an elastic member 43 to be retractable into the hinge channel 31*a*, and functions to rotate the lid 20 open or closed, in cooperation with the stationary cam 41. According to an embodiment of the present invention, a coil spring is used as the elastic member 43.

The stationary cam 41 has, at the first end thereof, a hinge projection 41*a*, and has, at a second end thereof, a cam part 41*b* and a cam shaft 41*c*. The hinge projection 41*a* passes through the hinge cap 32 to be outwardly projected from the hinge casing 31, thus allowing the stationary cam 41 to be mounted to the lid 20. The cam part 41*b* has an irregular shape corresponding to a shape of the movable cam 42, to cooperate with the movable cam 42. The cam shaft 41*c* extends from the center of the cam part 41*b*, and passes through the movable cam 42 to guide a reciprocating movement of the movable cam 42. Further, the hinge cap 32 has a first through hole 32*a* to allow the hinge projection 41*a* to pass through the hinge cap 32.

The movable cam 42 has a cam bushing that includes, at a first end thereof, a cam hole 42*a*, and at a second end thereof, a support part 42*c*. The cam hole 42*a* receives the cam part 41*b* of the stationary cam 41, with a plurality of cam projections 42*b* being formed on an inner surface of the cam hole 42*a* to cooperate with the cam part 41*b* of the stationary cam 41. The cam part 41*b* has an irregular shape approximating a cylindrical shape with twisted troughs. The support part 42*c* extends into the elastic member 43, thus allowing the elastic member 43 to stably bias the movable cam 42. Further, a second through hole 42*d* is formed at a predetermined portion of the movable cam 42 to allow the cam shaft 41*c* of the stationary cam 41 to pass through the movable cam 42.

Thus, when a user rotates the lid 20, the movable cam 42 moves into the hinge channel 31*a* while elastically deforming the elastic member 43. At this time, the movable cam 42 executes a rotating motion relative to the stationary cam 41, and the movable cam 42 reciprocates in the hinge channel 31*a*. In this case, when the lid 20 is rotated beyond a predetermined angle, an elastic restoring force generated from the elastic member 43 transfers through the cam projections 42*b* to the cam part 41*b*. Therefore, the lid 20 is rotated to open or close the storage compartment 11.

Referring to FIG. 1, seating recesses 21 are formed at both sides, or edges, of a rear end of the lid 20. Each of the seating recesses 21 has a shape corresponding to the shape of the hinge projection 41*a*, thus allowing the hinge projection 41*a*, which is outwardly projected from the hinge cap 32, to be seated in the associated seating recess 21. Cover members 22 are mounted to both sides of the rear end of the lid 20, and cover the associated seating recesses 21 to make the hinge projections 41*a* be installed between the cover members 22 and the seating recesses 21, thus the lid 20 is hinged to the cabinet 10.

Specifically, according to an embodiment of the invention the hinge unit 30 is mounted to the upper portion of the rear portion of the cabinet 10 through the hinge bracket 33. Next, the hinge projections 41*a* are seated in the associated seating recesses 21, and then the cover members 22 are mounted to the both sides of the rear end of the lid 20. In this way, the lid 20 is rotatably mounted to the cabinet 10.

According to this embodiment, the stationary cam 41 has the cam part 41*b*, and the movable cam 42 has the cam projections 42*b*. Alternatively, the stationary cam 41 may have cam projections, and the movable cam 42 may have a cam part.

The assembly and operational effect of the hinge unit according to an aspect of the present invention will be described in the following in detail. The process of assembling the hinge unit 30 of the kimchi refrigerator is as follows. First, the cam units 40 are installed in the hinge channels 31*a* that are formed at both ends of the hinge casing 31. That is, the elastic member 43, the movable cam 42, and the stationary cam 41 of each of the cam units 40 are sequentially installed in the hinge channel 31*a*. Next, each of the hinge caps 32 is mounted to the associated hinge channel 31*a*. Thus, the first and second cam units 40 are installed in both sides of the hinge casing 31.

Thereafter, the hinge casing 31 is mounted to the upper portion of the rear side portion of the cabinet 10 by the hinge bracket 33. The hinge projections 41*a*, which are outwardly projected from the hinge caps 32, are seated in the seating recesses 21 formed on both sides, or edges, of the rear end of the lid 20. Then, the cover members 22 are mounted to the lid 20 to set the hinge projections 41*a* between the lid 20 and the cover members 22. Therefore, according to the present invention, it is possible to easily mount the lid 20 to the upper portion of the rear portion of the cabinet 10 by the single hinge unit 30.

As apparent from the above description, the present invention provides a kimchi refrigerator with a hinge unit which is designed such that first and second cam units are mounted to opposite ends of a hinge casing, respectively, thus allowing both sides of the lid to be rotatably mounted to a cabinet, therefore allowing the lid to be easily mounted to the cabinet using a single hinge unit. However, while described in terms of a kimchi refrigerator, it is understood that the invention could be used for other food storage containers either with or without parts that mechanically change a temperature in a storage compartment. Moreover, it is to be appreciated that the invention may be used with non-food storage compartments, or for compartments that heat the stored contents. Further, the hinge unit of the present invention could also be used with other hinge units, according to need.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A kimchi refrigerator, comprising:

a cabinet to define an external appearance of the kimchi refrigerator, the cabinet having a storage compartment to store food, the storage compartment being opened at a top thereof to form an opening and being cooled by cooling elements;

a lid hinged to a predetermined portion of the cabinet to selectively close the opening of the cabinet; and a hinge unit to hinge the lid to the predetermined portion of the cabinet, with first and second cam units included at corresponding ends of the hinge unit to mount to both sides of the lid to rotatably open or close the lid, wherein the hinge unit comprises:

a hinge casing having a longitudinal open hinge channel at each end thereof to mount the first and second cam units to both ends of the hinge casing; and a hinge cap disposed at each end of the hinge casing to cover the open hinge channel, thus preventing each of the first and second cam units from being removed from the hinge channel, and wherein each of the first and second cam units comprises:

a stationary cam having a hinge projection at a first end thereof, and having a cam part at a second end thereof, the hinge projection passing through the hinge cap to be mounted to the lid and the cam part having an irregular form that is generally cylindrical shape with twisted troughs;

a movable cam having a plurality of cam projections at a first end thereof to correspond to the irregular form of the cam part; and an elastic member to elastically bias a second end of the movable cam, thus allowing the movable cam to be retractably set in the hinge channel according to the interaction between the cam part having the irregular form and the cam projections of the movable cam.

2. The kimchi refrigerator according to claim 1, further comprising:

seating recesses formed at both sides of a rear end of the lid to correspond to a shape of the hinge projections, thus allowing the hinge projections to be seated in the seating recesses, respectively; and a cover member mounted to the lid to cover each of the seating recesses, thus allowing each of the hinge projections to be installed between the seating recesses and the cover member.

3. A refrigerator comprising:

a cabinet housing a plurality of refrigeration components and a climate controlled food storage compartment that includes an opening selectively covered by a lid; and a single hinge unit coupling the cabinet and the lids, wherein the single hinge unit comprises:

a hinge casing adapted to mount cam units at opposite ends of the hinge; and a pair of hinge caps that restrain the cam units in the hinge casing, and wherein the cam units each comprise:

a stationary cam having a hinge projection passing through the hinge cap at a first end, and having a cam part at the distal end, the hinge projection adapted to be mounted to the lid;

a movable cam operably engaging the cam part; and a biasing member to place the movable cam under tension.

4. The refrigerator as in claim 3, wherein the lid has seating mounts at opposite corners of one edge of the lid adapted to fit the stationary cams.

5. The refrigerator as in claim 4, further comprising cover members attached to the lid to couple the hinge unit to the lid.

6. The refrigerator as in claim 3, wherein the biasing member includes an elastic member to elastically bias the movable cam by allowing the movable cam to be retractably set in the hinge channel according to the engagement between the cam part and the movable cam.

7. A kimchi refrigerator comprising:

a cabinet housing a plurality of refrigeration components and a climate controlled food storage compartment having an opening;

a single hinge unit casing having a pair of cam units at each end attached to the cabinet;

a lid having a pair of retention seats for coupling with the cam units so as to rotate to cover the opening; and a pair of covers for retaining the cam units in the retention seats, wherein of the cam units each comprise:

a stationary cam having a hinge projection at a first end, and having a cam part at the opposite end; and a movable cam operably engaging the cam part.

8. The kimchi refrigerator as in claim 7, wherein the movable cam is placed under tension by an elastic member.

9. A hinged storage compartment comprising:

a cabinet housing that includes an opening selectively covered by a lid; and a single hinge unit coupling the cabinet and the lid, wherein the single hinge unit further comprises:

a hinge casing adapted to mount a cam units at opposing ends of the hinge casing; and a pair of hinge caps that restrain the cam units in the hinge casing, and wherein the cam units each comprise:

a stationary cam having a hinge projection passing through the hinge cap at a first end, and having a cam part having a generally cylindrical shape defining a plurality of curved troughs at the distal end, the hinge projection adapted to be mounted to the lid;

a movable cam having a plurality of protections operably engaging the curved troughs of the cam part; and an elastic biasing member to place the movable cam under tension to elastically bias the movable cam by allowing the movable cam to be retractably set in the hinge channel according to the engagement between the cam part and the movable cam.

* * * * *

UNITED STATES PATENT AND TRADEMARK OFFICE

CERTIFICATE OF CORRECTION

PATENT NO. : 7,127,911 B2
APPLICATION NO. : 10/729991
DATED : October 31, 2006
INVENTOR(S) : Jeong-Man Nam et al.

It is certified that error appears in the above-identified patent and that said Letters Patent is hereby corrected as shown below:

Column 5, Line 38, change “lids,” to --lid,--.

Column 6, Line 45, change “protections” to --projections--.

Signed and Sealed this

Sixth Day of March, 2007

JON W. DUDAS
*Director of the United States Patent and Trademark Office*